US006766594B2

(12) United States Patent
DuRapau

(10) Patent No.: US 6,766,594 B2
(45) Date of Patent: Jul. 27, 2004

(54) DRYER APPARATUS FOR BOOTS AND GLOVES

(75) Inventor: Rick DuRapau, Austin, TX (US)

(73) Assignee: Scientific Molding Corporation, Somerset, WI (US)

( * ) Notice: Subject to any disclaimer, the term of this patent is extended or adjusted under 35 U.S.C. 154(b) by 0 days.

(21) Appl. No.: 10/291,242

(22) Filed: Nov. 8, 2002

(65) Prior Publication Data

US 2004/0088879 A1 May 13, 2004

(51) Int. Cl.[7] ..... F26B 3/00
(52) U.S. Cl. ..... 34/437; 34/104; 34/90
(58) Field of Search ..... 34/437, 104, 107, 34/442, 237, 90, 103

(56) References Cited

U.S. PATENT DOCUMENTS

| | | | | | |
|---|---|---|---|---|---|
| 4,596,078 | A | | 6/1986 | McCartney | 34/103 |
| 4,727,656 | A | | 3/1988 | Jannach et al. | 34/104 |
| 4,768,293 | A | | 9/1988 | Kaffka | 34/104 |
| 4,774,769 | A | | 10/1988 | Dollst | 34/60 |
| 4,787,153 | A | | 11/1988 | Chen | 34/87 |
| 5,003,707 | A | | 4/1991 | Chu | 34/104 |
| 5,058,289 | A | | 10/1991 | Guindon | 34/104 |
| 5,115,580 | A | | 5/1992 | Blumenfeld et al. | 34/104 |
| 5,179,790 | A | * | 1/1993 | Poulos | 34/104 |
| 5,199,188 | A | | 4/1993 | Franz | 34/105 |
| 5,222,308 | A | | 6/1993 | Barker et al. | 34/104 |
| 5,287,636 | A | | 2/1994 | Lafleur et al. | 34/104 |
| 5,289,642 | A | | 3/1994 | Sloan | 34/104 |
| 5,379,525 | A | | 1/1995 | Raynor | 34/104 |
| 5,412,928 | A | * | 5/1995 | Reithel | 34/104 |
| 5,542,191 | A | | 8/1996 | Shouse et al. | 34/104 |
| 5,570,515 | A | | 11/1996 | Schulte | 34/104 |
| 5,632,099 | A | | 5/1997 | Seifert et al. | 34/106 |
| 5,720,108 | A | | 2/1998 | Rice | 34/104 |
| 5,729,908 | A | | 3/1998 | Braden | 34/104 |
| 5,819,433 | A | | 10/1998 | Crooks | 34/104 |
| D412,381 | S | | 7/1999 | Peet | D32/58 |
| 6,085,436 | A | | 7/2000 | Peet | 34/104 |
| 6,216,359 | B1 | | 4/2001 | Peet | 34/105 |

OTHER PUBLICATIONS

"Amish Deacon Bench Boot and Glove Dryer Models", *The Dry Place: Boot and Glove Dryer*, http://hometown.aol.com/bootdryer/DB.html, (Sep. 23, 2003), 2 pgs.

* cited by examiner

*Primary Examiner*—Henry Bennett
*Assistant Examiner*—Camtu Nguyen
(74) *Attorney, Agent, or Firm*—Schwegman, Lundberg, Woessner & Kluth, P.A.

(57) ABSTRACT

A drying apparatus including a body portion including an upwardly extending drying member which has an upper portion for holding an item of apparel, and a platform coupled to the body portion. The platform can be moved into a first, generally horizontal position over the drying member and can be moved into a second, non-horizontal position not over the drying member such that a user has access to the upper portion of the drying member. The drying apparatus can include an air freshener.

18 Claims, 3 Drawing Sheets

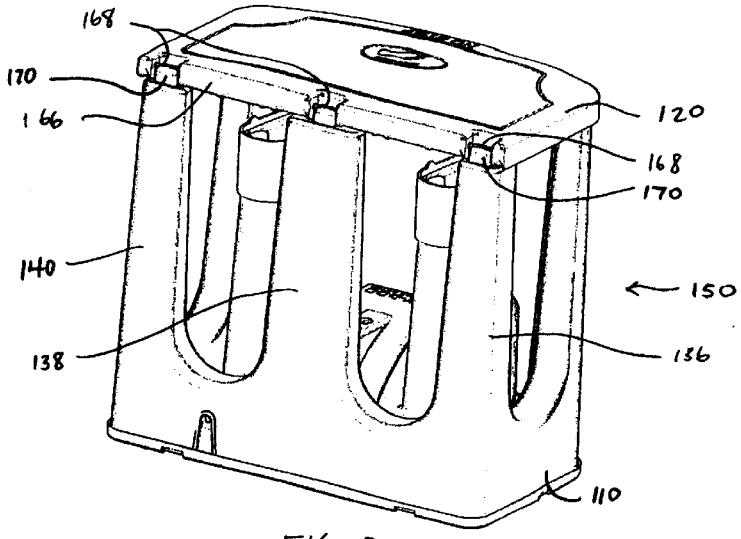
FIG. 3
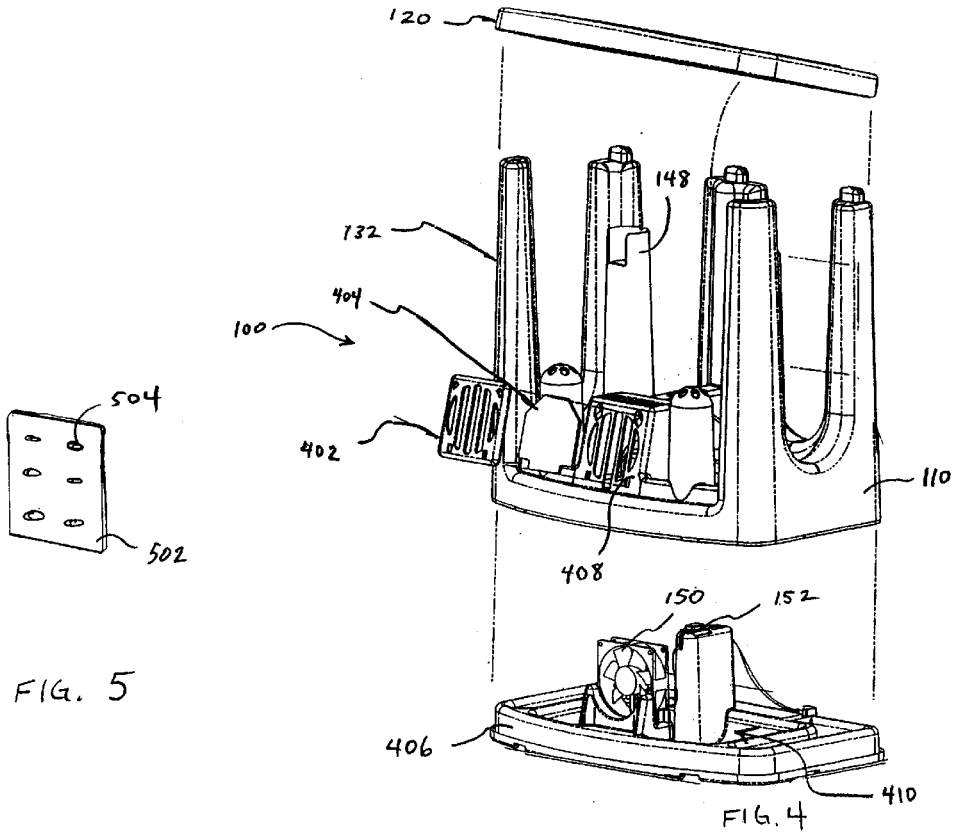
FIG. 5
FIG. 4

DRYER APPARATUS FOR BOOTS AND GLOVES

FIELD OF THE INVENTION

This invention relates to the field of dryers, and more specifically to an apparatus for drying of items of apparel.

BACKGROUND

Garment dryers, such as boot and glove dryers, typically include a drying post which is placed inside the boot, for example. A fan then forces air through the post and into the boot. Some dryers omit a fan and use electric heat or gas heat in a convection process. All these boot dryers can be obtrusive, though. While being used, they can be in the way and can be unsightly. After being used, they add to the clutter of a room. Accordingly, there is a need for a boot and glove dryer that can be easily used without being obtrusive.

SUMMARY

In one aspect, a drying apparatus including a body portion including an upwardly extending drying member for holding an item of apparel. The drying apparatus also includes a platform coupled to the body portion and located above the drying member. In one example, the platform can be moved from a first, generally horizontal position covering over the drying member to a second, non-horizontal position not covering over the drying member such that a user has access to the drying member. In one option, a drying apparatus includes a air freshener.

BRIEF DESCRIPTION OF THE DRAWINGS

FIG. 3 shows a rear perspective view of the drying apparatus of FIG. 1.

FIG. 4 shows an exploded view of the drying apparatus of FIG. 1.

FIG. 5 shows a perspective view of a scented card member according to one embodiment.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
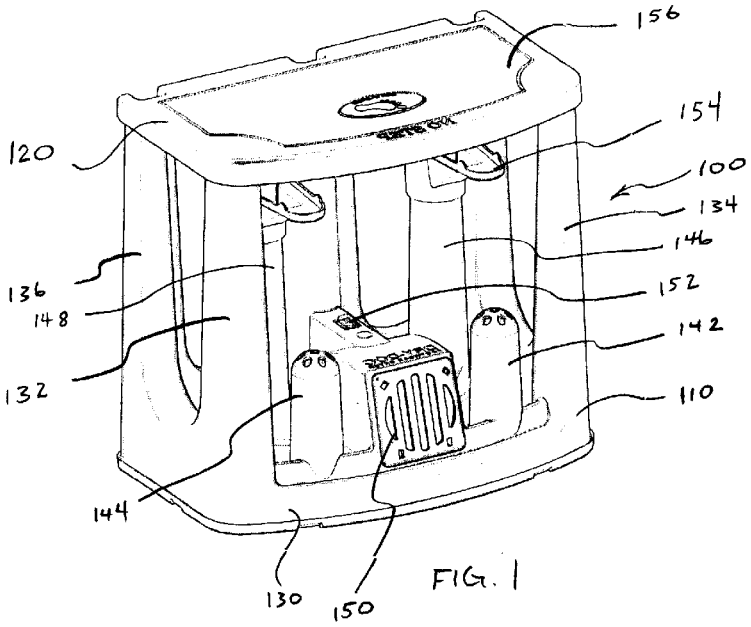
FIG. 1 is a perspective view of a drying apparatus according to one embodiment.
Figure 2:
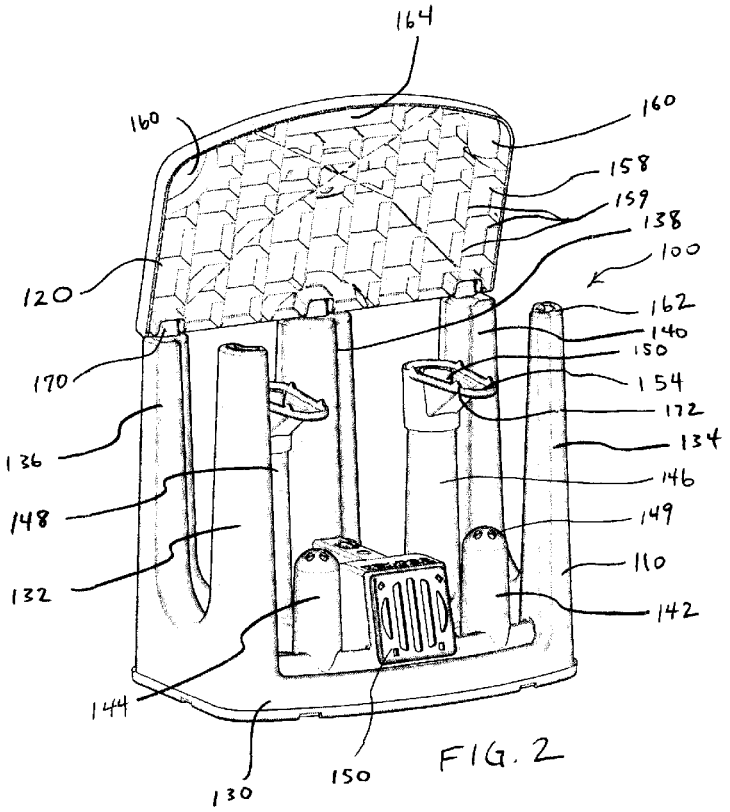
FIG. 2 is a perspective view of the drying apparatus of FIG. 1 with the platform raised.

FIGS. 1 and 2 show a perspective view of a drying apparatus 100 according to one embodiment. Drying apparatus 100 includes a body portion 110 and a platform 120.

Body portion 110 includes one or more drying members 142, 144, 146, and 148. Platform 120 is located above the drying members and is coupled to body portion 110. In one embodiment, platform 120 is movably coupled to body portion 110 such that platform 120 can be moved into a first, generally horizontal position covering over the drying members 142–148 (as shown in FIG. 1) and can also be moved into a second, non-horizontal position (as shown in FIG. 2). In other embodiments, the platform is movably coupled to the body portion such that the platform rests on top of the body portion and a user can lift the entire platform off of the legs to provide access to the drying members. In some embodiments, the platform is permanently coupled to the body portion in the horizontal orientation.

When platform 120 is oriented as shown in FIG. 2, a user has access to the drying members 142–148 allowing the user to place or remove items of apparel, such as boots, shoes, socks, and gloves upon the drying members. When lowered to a horizontal location, the platform provides a stool or seat without getting in the way of or adversely affecting the drying process. The overall bench-style appearance of drying apparatus 100 thus provides an aesthetically pleasing overall structure relative to stand-alone drying systems which end up cluttering a room when not in use, and which can be unsightly while in use. Drying apparatus 100 presents a neat, clean appearance when either in use or out of use.

In one embodiment, body portion 110 generally includes a bottom portion 130 having one or more support members such as legs 132, 134, 136, 138, and 140 extending upwardly therefrom. Other embodiments can have more or fewer legs or support members. Platform 120 rests upon and is supported by legs 132–140.

In one embodiment, platform 120 is hingedly coupled to one or more of rear legs 136, 138, and 140 and platform 120 can rotate up and down around an axis defined by the connection to the rear legs. When platform 120 is in a down position, the front of platform 120 is supported by front legs 132 and 134.

Drying members 142, 144, 146, and 148 are elongated posts extending upwardly from bottom portion 130. In one embodiment, each of the drying members 142–148 are positioned generally on or within the boundary defined by support members 132–140. Thus, when platform 120 is supported upon the support members, the platform completely covers over drying members 142–148.

In one embodiment, each of drying members 142–148 includes a hollow tube having a bottom opening in communication with a fan 150. In one embodiment, fan 150 is an electric fan controlled by a switch 152. Fan 150 is coupled to body portion 110 and configured to blow air through the drying members 142–148. Fan 150 draws air into a plenum where the air is then dispersed into each of the drying members. The air exits each drying member through openings 149 and 150 in the upper portion of each drying member. When a sock, shoe, boot, glove, or other garment or item of apparel is placed over the openings, the airflow into the item helps dry out the item.

In one embodiment, four drying members 142–148 are provided. The front pair of drying members 142 and 144 are shorter than the rear pair of drying members 146 and 148. The front pair of drying members 142 and 144 each include a plurality of openings 149 proximate the upper end of each drying member 142 and 144. These relatively short drying members 142 and 144 are dimensioned to provide room for drying gloves, socks or shoes, for example, when the taller, rear pair of drying members 146 and 148 have boots or shoes on them. The smaller size minimizes any conflict between the items of apparel on each drying member. Other embodiments can provide more or fewer drying members. One or more removable adapters 154 can be inserted over the top of one or more of the drying members. For example, adapter 154 can have a general foot-shape to provide better support and airflow into a shoe or boot. In one embodiment, protrusions 172 extend from each adapter 154 to provide an air-flow gap between the opening 150 and the inner surface of the boot or shoe.

In one embodiment, platform 120 includes a top surface 156 and a bottom surface 158, and can be dimensioned to substantially cover the footprint of the drying apparatus. Top surface 156 can be a generally smooth surface. In one embodiment, bottom surface 158 includes a plurality of structural supports such as molded cross braces 159. An indentation portion 160 on the front corners of the bottom surface of platform 120 is dimensioned to mate with a top surface 162 of front support members 132 and 134. In one embodiment, front support members 132 and 134 have a slightly rounded cross section profile, thus providing both front and side support of platform 120 when it is in a lowered position. An indented hand portion 164 is provided in one embodiment to help grip the platform when raising and lowering it.

FIG. 3 shows a rear perspective view of drying apparatus 100. The back side 166 of platform 120 includes one or more hinge members 168 which hingedly mate with an upper portion 170 of rear support members 136–140.

FIG. 4 shows an exploded view of drying apparatus 100 according to one embodiment. FIG. 4 shows rear drying member 148 with adapter 154 (FIGS. 1 and 2) removed. In one embodiment, drying apparatus includes a lower base 406 which has fan 150 and switch 152 mounted to the base. Lower base 406 mounts to body 110 such that fan 150 is housed within a fan housing 408. An optional filter 404 and a filter guard 402 are mounted over the air intake of fan housing 408. Filter 404 can include an electrostatic filter to help prevent bacterial growth. Some embodiments omit the filter.

In one embodiment, drying apparatus 100 is configured to provide a scented air or air-freshened air-flow through one or more of the drying members 142–148. For example in one embodiment, filter 404 can include a scented filter which freshens or scents the air as it flows through the apparatus. FIG. 5 shows a scented member 502 according to one embodiment. Scented member 502 can include a plastic or paper card having one or more perforations 504 going through the card body. The card body can be impregnated with a scent or fragrance and the card can be positioned between filter guard 402 and the front of fan housing 408, with or without filter 404, for example. Again, this freshens the airflow as the air passes through the apparatus. Referring to FIG. 2, in one embodiment adaptors 154 can be molded or impregnated with a scented material or scent. Again, this freshens the airflow as the air passes through the apparatus. Examples of scents or fragrances include, by way of example and not limitation, vanilla, cinnamon, orange, cherry, spearmint, lilac, and fir, etc.

Referring again to FIG. 4, in one embodiment the structural members of body 110, for example, the support members 132–140 and the drying members 142–148 are an integral unit molded as a single piece. This simplifies the manufacturing complexities of the hinged platform drying apparatus 100.

In this example, a plenum 410 is formed between body 110 and lower base 406 when they are mounted together. Air flow goes through the fan into the fan housing 408 and plenum 410 and then exits through one or more of drying members 142–148 which are open to the plenum. Again, this two-part molded structure provides for ease of manufacturing. Body 110 includes all the support members and drying members in an integrated, molded structure, and lower base 406 is molded so as to form the plenum when it is mounted to body portion 110.

In one embodiment, fan 150 is an electric, 5 inch box fan. Other embodiments provide other types of fans and blowers. Some embodiments include an electric heater proximate the fan to provide heated air through drying members 142–148. In other embodiments of the present system, drying members 142–148 can include gas heat drying or electric heat drying. In some embodiments, fan 150 can be omitted and a heated-air, convection drying system is implemented.

Figure 6:
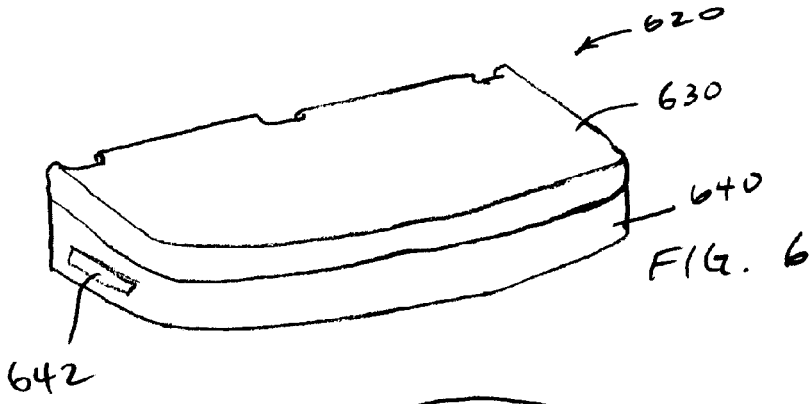
FIG. 6 shows a platform for a drying apparatus, in accordance with one embodiment.
Figure 7:
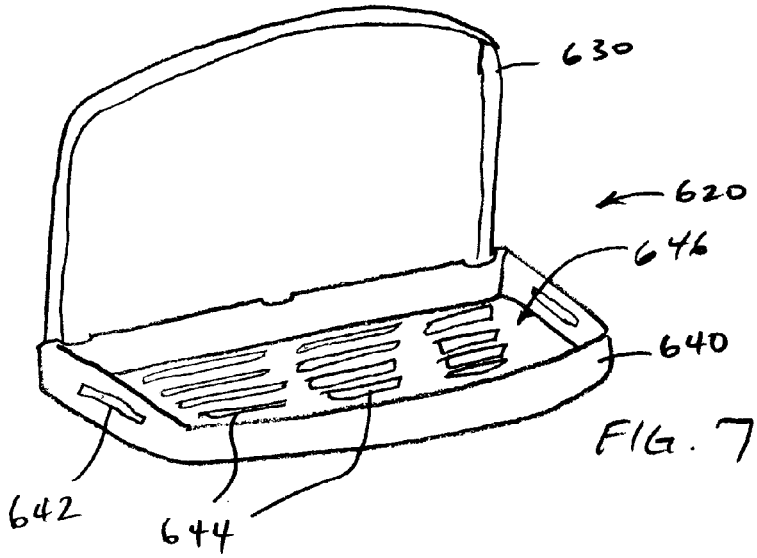
FIG. 7 shows the platform of FIG. 6 with an upper section of the platform raised.

FIGS. 6 and 7 show closed and open orientations of a platform 620, in accordance with one embodiment. Platform 620 can be used in place of platform 120 (FIG. 1). Platform 620 can include all the details and options discussed above for platform 120 and the above discussion is incorporated herein.

Platform 620 includes an upper section 630 and a lower section 640. Lower section 640 can be permanently or movably attached to base portion 110 (FIG. 1). In one embodiment, lower section 640 is hingedly attached to base portion 110 and rotates up and down to allow easy access to the drying members of the apparatus. Likewise, upper section 630 is movably attached to lower section 640. In one embodiment, upper section 630 is hingedly attached to lower section 640. Lower section 640 includes a tray portion 646. When upper portion 630 is moved away from the lower section, gloves, socks or other garments or apparel can be put into the tray section. Upper section 630 can then be lowered to cover over the tray portion.

Lower section 640 can include one or more slots or perforations 642 and 644 to allow an airflow through the lower section. Thus, a user can raise upper portion 630 and place an item within tray 646 and airflow from the drying members will enter the lower section through slots 644 to dry the items. Lower section 640 can also be moved to allow access to place a boot, for example, on the drying members. When the apparatus is turned on, some airflow will go through the boot and when it exits the boot go into the tray.

In one example use of drying apparatus 100, the platform is rotated upward. An item of apparel, such as a boot, shoe, sock, glove, and so on, is put over the upper portion of a given drying member such that the openings in the upper portion of the drying member open into the interior of the item of apparel. The switch is activated which turns the fan on, thus blowing forced air through the drying members and into the interior of the item of apparel. If the platform is raised, it can then be lowered and used as a seat or bench. When the item of apparel is dry, the platform is rotated upwards and the item is removed.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A drying apparatus comprising:

a body portion including an upwardly extending drying member having a lower end coupled to the body portion and in communication with a fan and an upper portion having an opening and for holding an item of apparel such that air is blown by the fan upwardly through the drying member and through the opening; and a platform movably coupled to the body portion and located above the drying member, wherein the platform can be moved from a first, generally horizontal position covering the drying member to a second, non-horizontal position not covering the drying member such that a user has access to the upper portion of the drying member.

2. The drying apparatus of claim 1, wherein the body portion includes a plurality of upwardly extending support members and the platform is hingedly coupled to one or more of the upwardly extending support members.

3. The drying apparatus of claim 1, wherein the fan is located in the base of the body portion.

4. The drying apparatus of claim 1, wherein the drying member includes a hollow rigid tube.

5. The drying apparatus of claim 1, wherein the body portion includes four upwardly extending drying members, a first pair of the four upwardly extending drying members being shorter than a second pair of the four upwardly extending drying members.

6. The drying apparatus of claim 1, wherein the platform includes lower tray section for holding items of apparel and an upper cover section to cover over the lower tray section.

7. A drying apparatus comprising:

a body portion including a plurality of support members;

a drying member extending upwardly from the body portion and located within an area bounded by the plurality of support members, the drying member including a hollow tube having a first end communicating with a fan to receive an airflow from the fan and having a second end having one or more openings to release the airflow from the drying member, wherein the second end is configured for holding an item of apparel; and a platform including a first, back side hingedly attached to one or more of the plurality of support members such that the platform can be rotated downward into a position horizontally oriented over the drying member and can be rotated upward allowing for access to the second end of the drying member, wherein when the platform is in the horizontal position, the first, back side of the platform is supported by one or more support members and a second, front side of the platform is supported by a different one or more of the plurality of support members.

8. The drying apparatus of claim 7, including four drying members, a first pair of the four drying members being shorter than a second pair of the four drying members.

9. The drying apparatus of claim 7, wherein the body portion, the plurality of support members, and the drying member are an integral unit of the apparatus.

10. The drying apparatus of claim 7, wherein the fan blows air upwardly through the drying member and through the openings in the second portion of the drying member.

11. The drying apparatus of claim 7, wherein the platform includes lower tray section for holding items of apparel and an upper cover section to cover over the lower tray section.

12. A drying apparatus comprising:

a body portion including an upwardly extending drying member which has an upper portion for holding an item of apparel; and a platform movably coupled to the body portion and located above the drying member, wherein the platform can be moved from a first, generally horizontal position covering the drying member to a second, non-horizontal position not covering the drying member such that a user has access to the upper portion of the drying member, wherein the body portion includes four upwardly extending drying members, a first pair of the four upwardly extending drying members being shorter than a second pair of the four upwardly extending drying members.

13. The drying apparatus of claim 12, wherein the body portion includes a plurality of upwardly extending support members and the bench is hingedly coupled to one or more of the upwardly extending support members.

14. The drying apparatus of claim 12, further including a fan coupled to the body portion and configured to blow air through the drying member.

15. A drying apparatus comprising:

a body portion including a plurality of support members;

four drying members, a first pair of the four drying members being shorter than a second pair of the four drying members, each drying member extending upwardly from the body portion and located within an area bounded by the plurality of support members, each drying member including a hollow tube having a first end communicating with a fan to receive an airflow from the fan and having a second end having one or more openings to release the airflow from the drying member, wherein the second end of each drying member is configured for holding an item of apparel; and a platform including a first side hingedly attached to one or more of the plurality of support members such that the platform can be rotated downward into a position horizontally oriented over the drying members and can be rotated upward allowing for access to the second end of each of the drying members.

16. The drying apparatus of claim 15, wherein the body portion, the plurality of support members, and the drying member are an integral unit of the apparatus.

17. The drying apparatus of claim 15, wherein the platform is supported by the plurality of support members when the platform is in the downward position.

18. The drying apparatus of claim 15, wherein the platform includes lower tray section for holding items of apparel and an upper cover section to cover over the lower tray section.

* * * * *